US010746505B2

(12) United States Patent
Tuller et al.

(10) Patent No.: US 10,746,505 B2
(45) Date of Patent: Aug. 18, 2020

(54) AIM ENHANCING SYSTEM

(71) Applicant: Lasermax, Inc., Rochester, NY (US)

(72) Inventors: Jeffrey D. Tuller, Rochester, NY (US); Brian L. Olmsted, Spencerport, NY (US)

(73) Assignee: LMD Power of Light Corporation, Rochester, NY (US)

( * ) Notice: Subject to any disclaimer, the term of this patent is extended or adjusted under 35 U.S.C. 154(b) by 0 days.

(21) Appl. No.: 16/227,570

(22) Filed: Dec. 20, 2018

(65) Prior Publication Data

US 2019/0383580 A1 Dec. 19, 2019

Related U.S. Application Data

(63) Continuation of application No. 15/482,165, filed on Apr. 7, 2017, now Pat. No. 10,161,716.

(51) Int. Cl.
*F41G 1/35* (2006.01)

(52) U.S. Cl.
CPC ..... *F41G 1/35* (2013.01)

(58) Field of Classification Search
CPC ..... F41G 1/32; F41G 1/34–36; G02B 23/24
USPC ..... 42/114–117, 132, 146; 362/110, 113, 362/114
See application file for complete search history.

(56) References Cited

U.S. PATENT DOCUMENTS 2,954,478 A * 9/1960 Bayle ..... H01J 31/501 250/333
5,194,007 A * 3/1993 Marshall ..... F41A 33/02 42/114
5,903,996 A * 5/1999 Morley ..... G02B 23/12 359/353
6,666,689 B1 * 12/2003 Savage, Jr. ..... H01R 13/717 362/378

(Continued)

OTHER PUBLICATIONS

Office Action for U.S. Appl. No. 15/482,165, dated Feb. 26, 2018, Jefferey D. Tuller, "Aim Enhancing System", 7 pages.

*Primary Examiner* — Samir Abdosh
(74) *Attorney, Agent, or Firm* — Lee & Hayes, P.C.

(57) ABSTRACT

Aim enhancing systems are provided for deterrent devices. In one aspect an aim enhancing system has a light emitting system; an optical element, a housing holding the laser system and the light emitting system and having an opening through which a light from the light emitting system can pass from inside the housing to outside the housing and an optical element receiving surface against which an outer surface of the optical element can be positioned, resilient biasing member having an opening through which the light can pass, an outer surface arranged to confront an inner surface of the optical element, and an inner surface; and a pressure surface pressing the inner surface of the resilient biasing member toward the optical element to resiliently hold the inner receiving surface against the outer surface of the optical element. The optical element is resiliently pressed against the housing and the housing and resilient (Continued)

element are shaped to cooperate when pressed together define a first barrier to contaminant travel into the housing through the opening and wherein the resilient biasing member is arranged to provide a second barrier to contaminant travel between the opening and the light emitting system.

19 Claims, 8 Drawing Sheets

(56) References Cited

U.S. PATENT DOCUMENTS

| | | | | |
|---|---|---|---|---|
| 6,985,313 | B1 * | 1/2006 | Savage, Jr. | G02B 7/022 359/811 |
| 6,985,913 | B2 * | 1/2006 | Murata | G06F 3/16 434/317 |
| D729,339 | S | 5/2015 | Chavez et al. | |
| D738,455 | S | 9/2015 | Homem de Mello Anderson et al. | |
| D746,405 | S | 12/2015 | Nemeyer et al. | |
| D749,689 | S | 2/2016 | Cheng et al. | |
| D757,886 | S | 5/2016 | Cheng et al. | |
| D762,806 | S | 8/2016 | Chavez et al. | |
| D763,399 | S | 8/2016 | Anderson | |
| 9,447,955 | B2 * | 9/2016 | Miller | F21L 4/027 |
| D776,783 | S | 1/2017 | St. Phillips et al. | |
| D781,983 | S | 3/2017 | Wells | |
| 9,658,031 | B1 | 5/2017 | Hedeen et al. | |
| 9,859,680 | B2 * | 1/2018 | Serbicki | H01S 5/02212 |
| D826,363 | S | 8/2018 | Kowalczyk, Jr. et al. | |
| 10,161,716 | B2 * | 12/2018 | Tuller | F41G 1/35 |
| 2004/0061957 | A1 * | 4/2004 | Savage, Jr. | G02B 7/022 359/811 |
| 2009/0116231 | A1 * | 5/2009 | Miller | F21L 4/027 362/208 |
| 2010/0164401 | A1 * | 7/2010 | Matthews | F21V 23/0414 315/294 |
| 2011/0162251 | A1 | 7/2011 | Houde-Walter | |
| 2012/0268920 | A1 * | 10/2012 | Matthews | F21V 23/0414 362/110 |
| 2014/0007485 | A1 * | 1/2014 | Castejon, Sr. | F41G 1/35 42/117 |
| 2015/0171594 | A1 * | 6/2015 | Serbicki | H01S 5/02212 372/38.02 |
| 2015/0276352 | A1 | 10/2015 | Chang et al. | |
| 2018/0292169 | A1 | 10/2018 | Tuller et al. | |

* cited by examiner

AIM ENHANCING SYSTEM

CROSS REFERENCE TO RELATED APPLICATIONS

This application is a continuation of U.S. application Ser. No. 15/482,165, filed Apr. 7, 2017, the entire disclosure of which is incorporated herein by reference.

STATEMENT REGARDING FEDERALLY SPONSORED RESEARCH OR DEVELOPMENT

N/A

FIELD OF THE INVENTION

Sights and illuminators for use with firearms and other deterrent devices.

DESCRIPTION OF RELATED ART

Visual aiming aids are becoming increasingly popular devices for use with firearms and other types of deterrent devices. For example, laser aiming devices are used to project a laser beam that is co-aligned at least in part with the firearm so as to allow a user to quickly determine where the firearm is being aimed while illuminators are used to provide artificial light in a scene to enable a user to more quickly identify threats. The visual aiming aids may emit light in visible wavelengths or in wavelengths that require electronic devices to sense the emitted light. The preferred forms of aiming and illuminati light may be different in different tactical scenarios.

Tactical users of firearms such as military, homeland security and law enforcement personnel may be called into situations on short notice or that may include changing tactical circumstances. Similarly, even those who use the firearms and deterrent devices in controlled circumstances such as for home security may face a range of potential scenarios with different needs and requirements. Accordingly, users of firearms and deterrent devices have sought visual aiming solutions that can be operated in a variety of modes.

One such multi-mode product is the Steiner Optics, DBAL-PL. The DBAL-PL functions in two operational modes: a visible mode that activates a visible laser and 400 lumen white light LED and an infrared mode that activates a Class 1 IR laser with an eye-safe IR LED illuminator for supplemental illumination. In the DBAL-PL mode selection is accomplished by activating either a visible light mode activation switch or an infrared light mode activation switch. However, the DBAL-PL is a complex to manufacture, large, and can be inefficient.

What is needed is an aim enhancing system that can perform multiple functions with any of less complexity, greater efficiency, smaller size and lower weight.

Additionally, such an aim enhancing system should be capable of surviving exposure to field contaminants such as dust, dirt, oils, sweat, water, snow, and residue if any from the discharge of the deterrent device. One approach to providing contaminant resistance in such optical systems is to use adhesives to tightly bind components together. However, many adhesives are vulnerable to breaks in shock and vibration. Another approach is the use of sealants such as silicone based sealants. For example, adhesives and sealants can be difficult to use in manufacturing, can crack, separate from surfaces or otherwise fail mechanically—particularly when exposed to extreme temperatures or to significant shock and vibration, can fail to fully bond to structures, can adhere or travel through wetting or other fluid dynamics to undesirable places such as onto optical elements, can be vulnerable to exposure to certain chemicals, can have physical characteristics that change significantly when exposed to high temperatures or can emit gasses over time after manufacture, with such gasses having or films formed from such gasses optical properties of the system. Further, there is the potential that gaps may arise in barriers created using adhesives or sealants due to human error in the application of adhesives and sealants.

Additionally, such an aim enhancing system should be capable of field maintenance without substantial risk of damage to the components or compromising the operation of the components. For example, such aiming systems from time to time may require cleaning of lenses or windows to remove contaminants from a light path. From time to time users may apply meaningful amounts of force against such windows or lenses. These amounts of force can be sufficient to damage adhesive bonds or seals between the lenses or windows and a housing, to damage coatings of the lenses or windows or to crack or damage the lenses or windows. These results are particularly to be avoided for field personnel who may have the greatest need to field clean their devices and who are least well positioned to replace them.

What are also needed therefore are aim enhancing devices that can withstand operations over a wider range of environmental conditions such as temperature extremes and exposure to contaminants while also easily cleaned and serviced.

SUMMARY OF THE INVENTION

Aim enhancing systems are provided for deterrent devices. In one aspect an aim enhancing system has a light emitting system; an optical element, a housing holding the lases system and the light emitting system and having an opening through which a light from the light emitting system can pass from inside the housing to outside the housing and an optical element receiving surface against which an outer surface of the optical element can be positioned, resilient biasing member having an opening through which the light can pass, an outer surface arranged to confront an inner surface of the optical element, and an inner surface; and a pressure surface pressing the inner surface of the resilient biasing member toward the optical element to resiliently hold the inner receiving surface against the outer surface of the optical element. The optical element is resiliently pressed against the housing and the housing and resilient element are shaped to cooperate when pressed together define a first barrier to contaminant travel the housing through the opening and wherein the resilient biasing member is arranged to provide a second harrier to contaminant travel between the opening and the light emitting system.

DETAILED DESCRIPTION OF THE DRAWINGS

Figure 1:
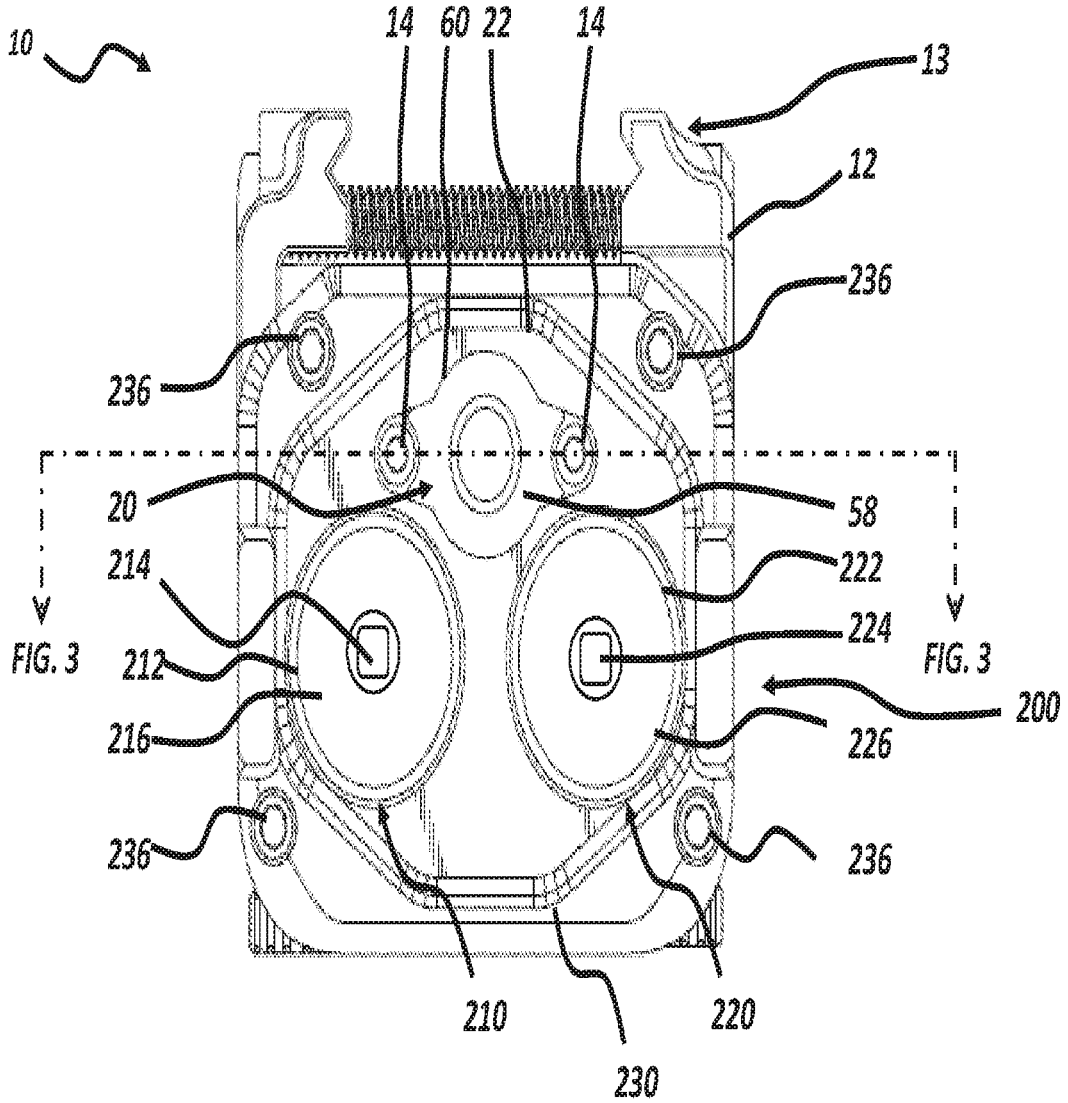
FIG. 1 shows a front elevation view of one embodiment of an aim enhancing system having a housing.
Figure 2:
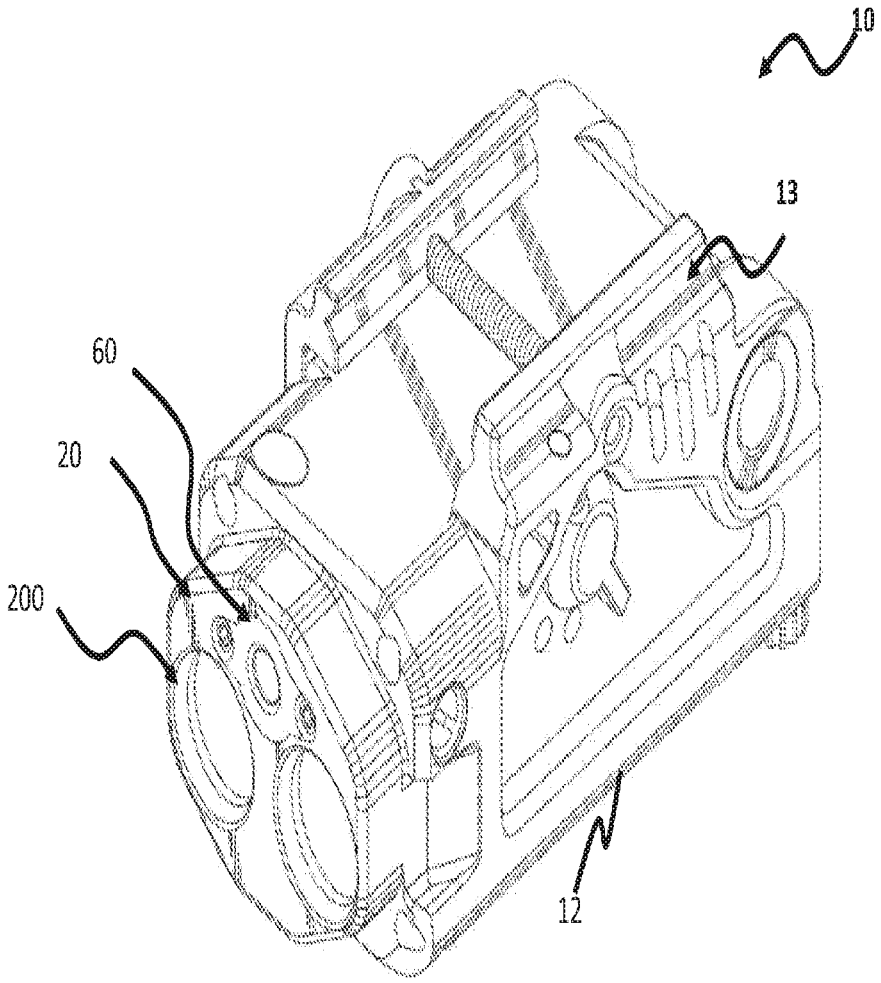
FIG. 2 shows a front, left side, top isometric view of the embodiment of FIG. 1.

FIG. 1 shows a front elevation view of one embodiment of an aim enhancing system 10 while FIG. 2 shows a front, left side, top isometric view of the embodiment of FIG. 1. As is shown in FIGS. 1-2, aim enhancing system 10 has a housing 12 with a mounting portion 13 configured to be joined mechanically to a deterrent device such as a rifle, pistol, or other amiable device capable of directing energy, materials or objects away from deterrent device. In this embodiment, aim enhancing system 10 has an aiming system 20 and an illumination system 200 and toward a target. Aiming system 20 is capable of emitting a narrow divergence beam of light, such as a collimated or substantially collimated beam of light, which may be a coherent beam of light such as that emitted by a laser module (not shown in FIGS. 1 and 2). The beam of light emitted by aiming system 20 travels along a path that approximates a trajectory taken by any directed energy, material(s), or object(s) directed by a deterrent device to which aim enhancing system 10 is mounted such that the beam of light intersects and is reflected by a target to indicate approximately where the directed energy, material(s) or object(s) will strike the target.

Illumination system 200 is capable of emitting light having a generally broader divergence than aiming system 20 and that can be used to add artificial light to an area or scene around confronting the use of the deterrent device. The light from illumination system 200 can be used, for example, to help a user of a deterrent device to identify targets, non-targets and other objects such as a weapon in the scene but can be used for other purposes such as signaling.

Figure 3:
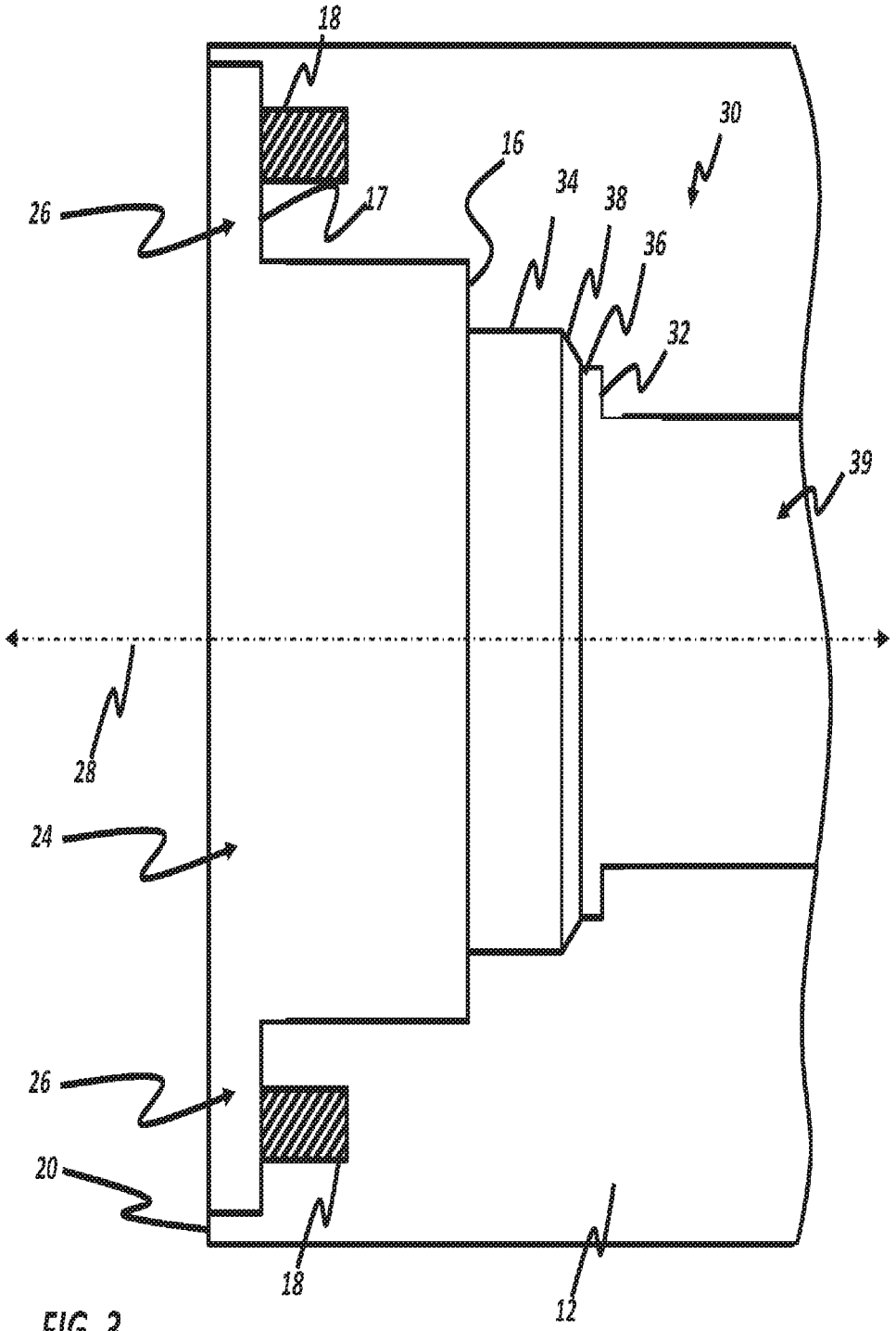
FIG. 3 is a cut away view of a one embodiment of a pocket of a housing used to receive an aiming system.
Figure 4:
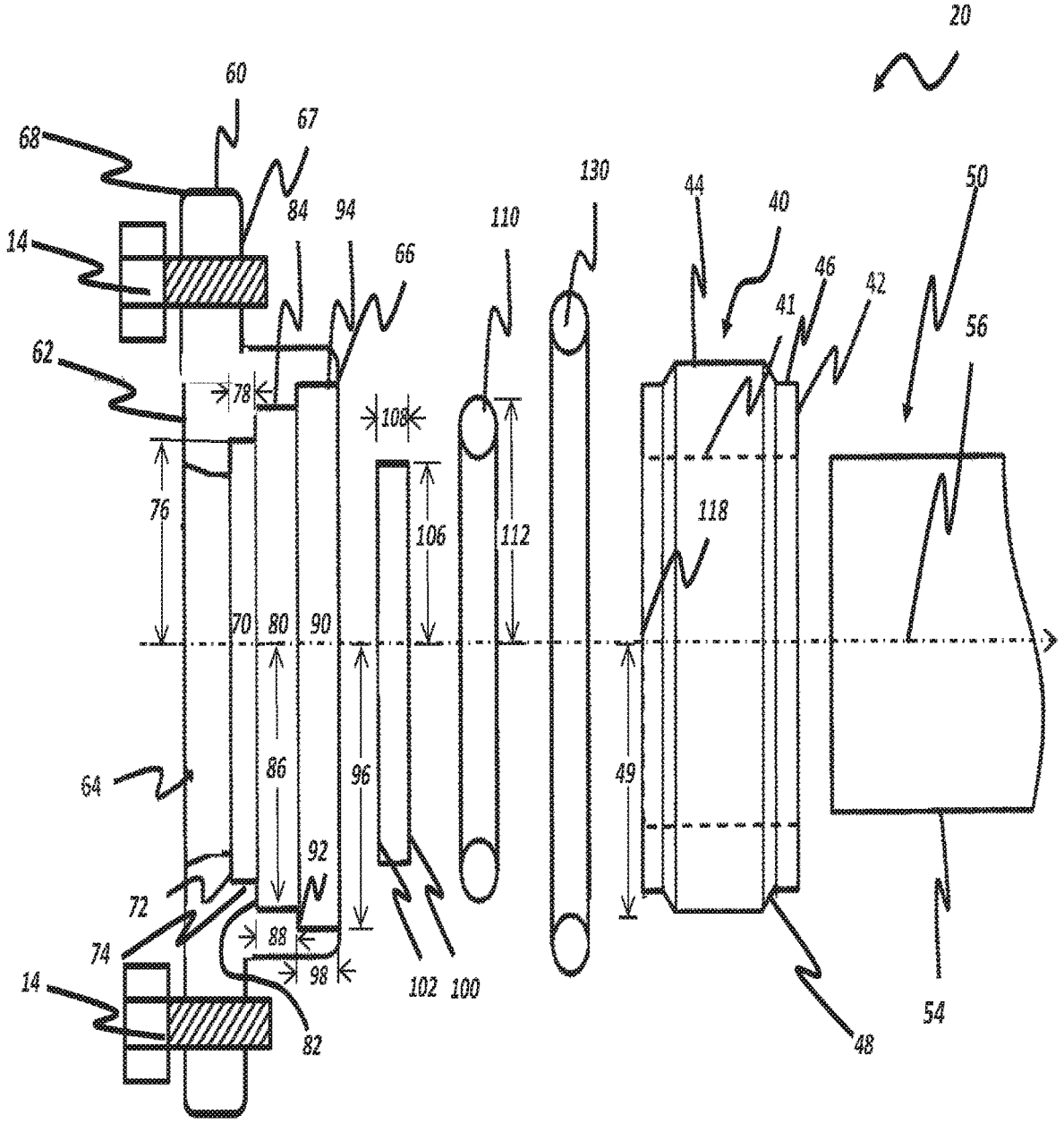
FIG. 4 is an assembly view of components of an aiming system that are assembled into the pocket of the housing and a cap.
Figure 5:
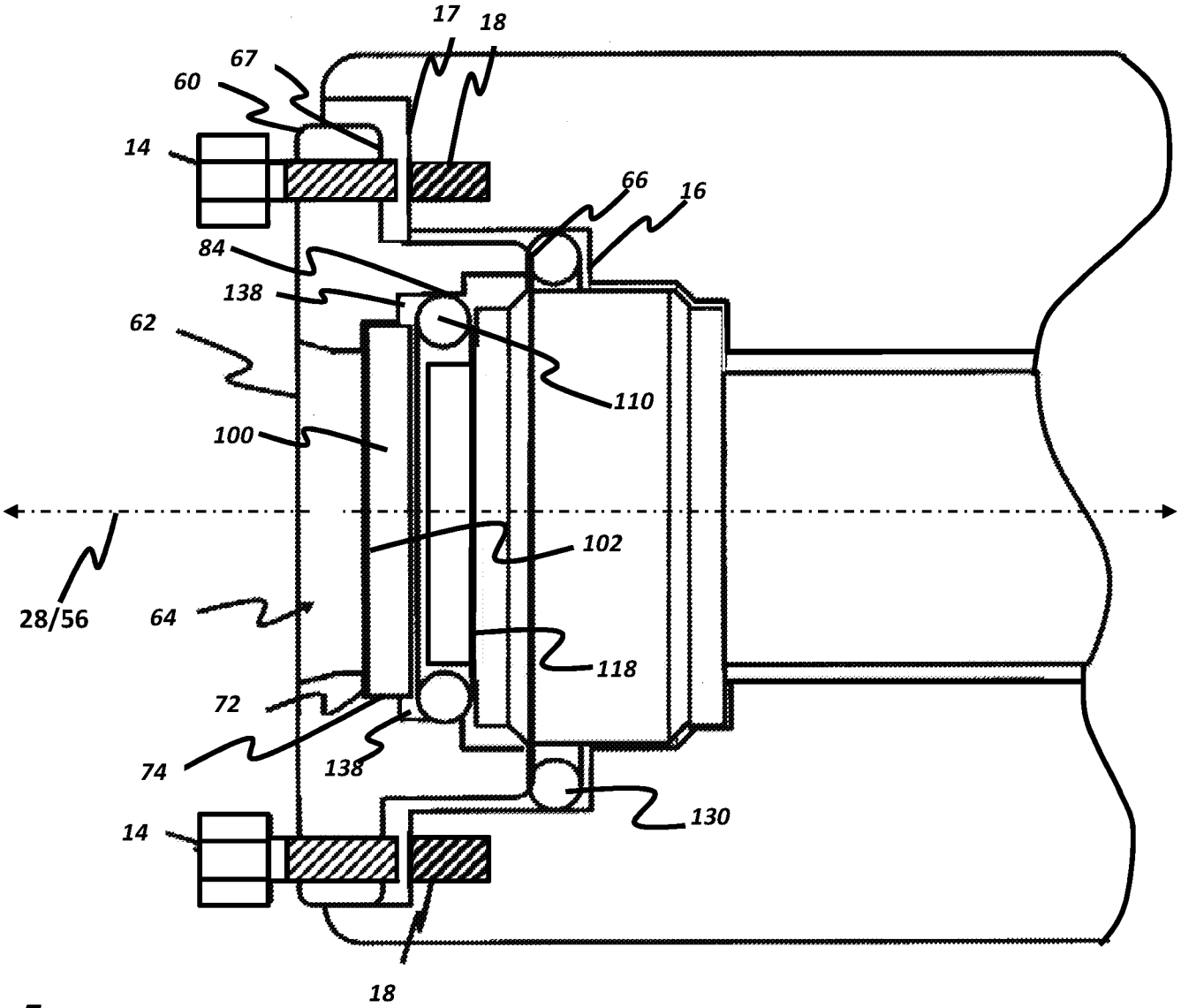
FIG. 5 illustrates a partially assembled view of the aiming system of FIGS. 1-4.

FIG. 3 is a cut away top down section view of a portion of housing 12 in which aiming system 20 is located in part and taken as shown in FIG. 1. FIG. 4 is an assembly view of components of aiming system 20 that are assembled between housing 12 and cap 60. FIG. 5 is a partially assembled view aiming system 20 of FIGS. 1-4 and FIG. 6 illustrates the embodiment of FIGS. 1-3 fully assembled.

As is shown in FIG. 3, housing 12 has a cap receiving portion 24 and a pocket 30. Cap receiving portion 24 is generally shaped to receive cap 60 and has cap mounting surfaces 18 to which cap fasteners 14 or other mountings can be joined.

In this embodiment, pocket 30 is shown having a pocket rear wall 32, a pocket outer wall 34, a pocket inner wall 36, and a transition portion 38 between pocket outer wall 34 and pocket inner wall 36. An adjustment space 39 extends behind pocket rear wall 32 and is sized and shaped both to receive an aiming illumination device shown here as a laser module 50 and to allow adjustment of the laser module 50. Laser module 50 may be adjusted along at least one axis that is normal to the longitudinal so that laser module 50 can be aligned with the a discharge axis of the deterrent device. In this regard, an adjustment space 39 is defined to provide a volume that is larger than a volume of laser module 50 and within which a rear portion of laser module 50 can be positioned within a range of non-parallel axes relative to a longitudinal housing axis 28 so that fine adjustments can be made to compensate for variations such as tolerance variations between aiming system 20 and a firearm or other deterrent device to which aim enhancing system 10 is joined. Adjustment of laser module 50 in such an environment can be made using, for example and without limitation, the methods and systems described in commonly assigned U.S. Pat. Nos. 8,683,731, 8,713,844 and 9,377,271 each entitled "Firearm Laser Alignment System" and each incorporated herein by reference in their entirety. In embodiments, aiming system 20 may emit non-laser light and may use optical systems to focus, collimate or substantially reduce the divergence of emitted light so as to create a beam of light that can be used for aiming purposes and such an aiming system 20 may be mounted and positioned in a manner similar to that illustrated with respect laser module 50.

In this embodiment, a pocket rear wall 32, a pocket outer wall 34, a pocket inner wall 36, pocket transition portion 38 and adjustment space 39 are optionally illustrated as being generally cylindrical and generally axially separated from and co-aligned along a longitudinal housing axis 28. In other embodiments, these features can have other shapes and need not necessarily be co-aligned.

In the embodiment of FIGS. 1-6, components of aiming system 20 include a resilient coupling 40 that holds a portion of a laser module 50 (shown in a partial cutaway view), a cap 60, an optical element 100, a resilient biasing member 110 shown here in the form of a ring and a resilient seal 130 also shown here in the form of a ring.

In the embodiment illustrated in FIGS. 1-6, laser module 50 has an outer wall 54 and resilient coupling 40 has a pathway 41 shown in phantom in FIG. 4 that extends through resilient coupling 40 (shown in phantom) and that is shaped and sized for mounting to outer wall 54. Resilient coupling 40 has a resilient coupling rear wall 42 that generally conforms to the shape of pocket rear wall 32, a resilient coupling outer wall 44 that generally conforms to the shape of pocket outer wall 34, a resilient coupling inner wall 46 that generally conforms to the shape of pocket inner wall 36 and transition portion 48 that generally conforms to shape of a pocket transition portion 38, accordingly, in this embodiment each follows a generally circular path about laser module 50.

In the embodiment illustrated, resilient coupling rear wall 42, resilient coupling outer wall 44, path 41 and transition portion 48 are sized and shaped to engage pocket rear wall 32, a pocket outer wall 34, a pocket inner wall 36, and a transition portion 38 respectively in a manner that positions laser module 50 at an initial position and orientation relative to pocket 30. In embodiments, resilient coupling 40 may have a path 41 with one or more receiving areas (not shown) such as indentations that are shaped and sized to engage protrusions (not shown) from laser module outer wall 54. Resilient coupling 40 is sufficiently resilient to elastically expand to permit a user to assemble any receiving areas of the resilient coupling 40 onto any protrusions and then close about the protrusions. This allows precise longitudinal and, optionally, radial alignment of resilient member 40 relative to laser module 50 and also allows helps to prevent longitudinal and optionally radial displacement of resilient member 40 relative to laser module 50 after assembly without using fixtures to ensure positioning or fasteners or adhesives to help maintain the positioning during use. Additionally, linking housing 12 to laser module 50 by way of resilient member 40 permits mechanical damping of inertial forces or shock experienced by aiming system 20 during operation so as to help protect against any misalignment potential damage to laser module 50.

Cap 60 has an external surface 62 with an opening 64 through which light can pass, an optical element receiving space 70, a resilient biasing member receiving space 80 and a resilient coupling receiving space 90.

Optical element receiving space 70 has an optical element engagement surface 72 against which an exterior facing surface 102 of optical element 100 can be positioned. In the embodiment of FIGS. 1-3 optical element engagement surface 72 begins at opening 64 and extends generally axially therefrom to an optical element receiving wall 74. In embodiments a shape of optical element engagement surface 72 and a shape of exterior facing surface 102 of optical element 100 may at least in part be substantially similar so that a portion of optical element engagement surface 72 and exterior facing surface 102 of optical element 100 can be maintained in substantial contact around opening 64 to form a primary barrier restricting entry of contaminants through opening 64 when such substantial contact is maintained.

Optical element receiving wall 74 defines a longitudinal separation between optical element engagement surface 72 and resilient biasing member receiving space 80 and is generally shaped and sized to enable a perimeter of optical element 100 to be positioned therein and to enable a thickness of optical element 100 or a portion thereof to be positioned therein. Optionally, a perimeter of optical element receiving wall 74 can be larger than a perimeter of optical element 100. For example, in the embodiment of FIGS. 1-6, optical element 100 is illustrated as a disk shaped window having an optical element radius 106 while optical element receiving wall 74 takes a generally cylindrical form having an optical element receiving wall radius 76 that is larger than optical element radius 106. Optical element receiving wall 74 is further has a depth 8 to enable a thickness of optical element 100 or a portion thereof to be positioned within optical element receiving space 70.

Resilient biasing member receiving space 80 includes a resilient biasing member engagement surface 82 that may begin at an end of optical element receiving wall 74 and that extends at least in part axially away from resilient biasing member engagement surface 82 to a resilient biasing member receiving wall 84. Resilient biasing member receiving wall 84 extends from resilient biasing member engagement surface 82 to define a longitudinal separation between resilient biasing member engagement surface 82 and resilient coupling receiving space 90. Resilient biasing member receiving space 80 is generally shaped and sized to enable a perimeter of resilient biasing member 110 to be positioned therein. For example, in the embodiment of FIGS. 1-6, resilient biasing member receiving space 80 is shown as being generally cylindrical and having a radius 86 that is larger than a radius 112 of resilient biasing member 110, optical element receiving wall radius 76 and optical element radius 106. Resilient biasing member receiving wall 84 is further has a depth 884 to enable a thickness of resilient biasing member 110 or a portion thereof to be positioned within resilient biasing member receiving space 80.

Resilient coupling receiving space 90 includes a resilient coupling engagement surface 92 that may begin at an end of resilient biasing member receiving wall 84 and that extends at least in part axially away from resilient coupling engagement surface 92 to a resilient coupling receiving wall 94. Resilient coupling receiving wall 94 extends from resilient coupling engagement surface 92 to define a longitudinal separation between resilient biasing member engagement surface 82 and resilient coupling receiving space 90. Resilient coupling receiving space 90 is generally shaped and sized to enable a perimeter of at least a portion of resilient coupling 40 to be positioned therein. For example, in the embodiment of FIGS. 1-6, resilient coupling receiving space 90 is shown as being generally cylindrical and having a radius 96 that is larger than a radius 49 of resilient coupling 40.

Resilient coupling receiving will 94 is further sized and shaped to enable a thickness of resilient biasing member 110 or a portion thereof to be positioned within resilient coupling receiving space 90. In this embodiment, resilient coupling receiving wall 94 and resilient coupling 40 is sized and shaped such that a portion of resilient coupling 40 can pass through resilient coupling receiving space 90 to position a pressure surface 118 to confront resilient biasing member 110. In this embodiment, optical element 100 is shown having a thickness 108 that is greater than a longitudinal length 78 of optical element receiving wall 74 so that a portion of optical element 100 will extend, in part, into depth 88 of resilient biasing member receiving space 80 when seated against optical element engagement surface 72.

As is shown in FIG. 5, a gap 138 exists between resilient biasing member engagement surface 82, resilient biasing member receiving wall 84 and optical element 100. Additionally, where, as shown here, there is a separation between optical element receiving wall 74 and optical element 100, gap 138 may extend into this separation.

Figure 6:
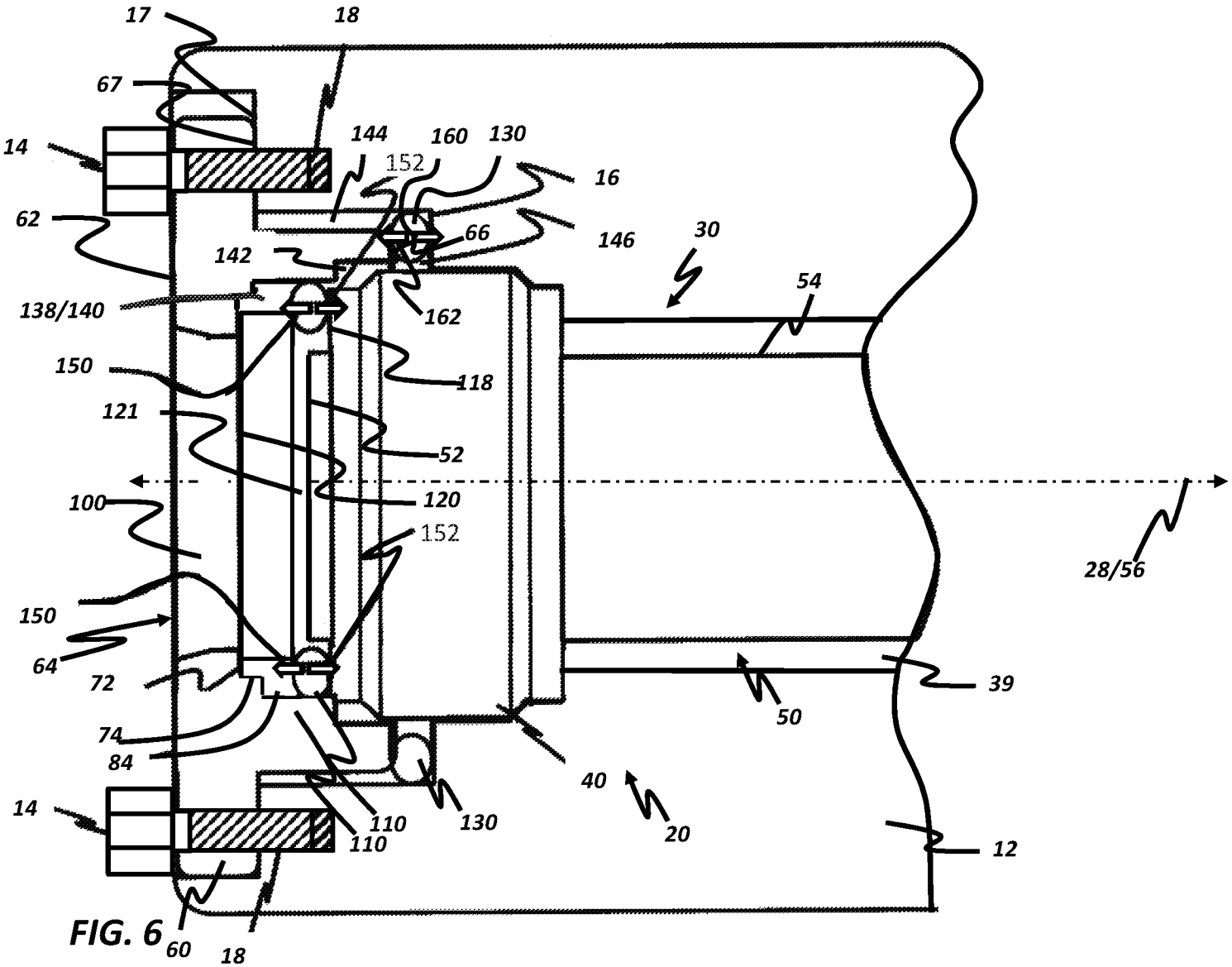
FIG. 6 illustrates the embodiment of FIGS. 1-5 fully assembled.

During assembly, optical element 100 is positioned between optical element engagement surface 72 and resilient biasing member 80 and resilient biasing member 80 is positioned between optical element 100 and pressure surface 118 of resilient member 40. Cap 60 is then positioned so that cap mounting lugs 68 are positioned in cap mounting areas 26. In this embodiment, cap fasteners 14 extend from cap mounting lugs 68 of cap 60 and cap receiving portion 24 of housing 12 has cap mounting areas 26 to receive cap mounting lugs 68. Cap mounting areas 26 in turn have cap mounting surfaces 18 that are positioned to receive and engage with similarly threaded cap fasteners 14 to mount cap 60 to housing 12. Cap fasteners 14 are then tightened to join cap 60 to housing 12 as is shown in FIG. 6. Other methods, structures and mechanisms can be used to mount cap 60 to housing 12.

As is also shown in FIGS. 4-6, resilient biasing member 110 is sized, shaped and positioned so that when cap 60 is joined to housing 12, resilient biasing member 110 is positioned to confront gap 138 and resilient seal 130 is sized, shaped and positioned so that when cap 60 is joined to housing 12, resilient seal 130 is positioned between a cap seal engagement surface 66 of cap 60, and housing seal compression surface 16 of housing 12. Housing 12 and cap 60 are configured so that a tightening of cap 60 onto housing 12 closes a separation between optical element 100 and a pressure surface 118, which, in this embodiment, is illustrated as a front surface of resilient coupling 40. This applies compressive forces against resilient biasing member 110.

Resilient biasing member 110 has a hardness and resists these compressive forces with resilient bias forces 150 and 152 that are applied against optical element 100 and pressure surface 118 respectively. Force 150 presses against optical element 100 to close or reduce the extent of any gaps between exterior facing surface 102 of optical element 100 and optical element engagement surface 72 so as to create or enhance an extent to which the interaction between optical element engagement surface 72 and exterior facing surface 102 provides a first contaminant barrier between an environment outside of aim enhancing system 100 and an environment inside aim enhancing system and an interior of housing 12.

Application of force 152 against pressure surface 118 of resilient coupling 40 closes gaps, if any, between resilient coupling 40 and pocket 30 such as by urging one or more of resilient coupling rear wall 42, resilient coupling outer wall 44, resilient coupling inner wall 46 and resilient coupling transition portion 48 into engagement with pocket rear wall 32, pocket outer wall 34, pocket inner wall 36, and pocket transition portion 38 respectively. In embodiments, one or more surfaces of resilient coupling 40 such as resilient coupling rear wall 42, resilient coupling outer wall 44, resilient coupling inner wall 46 and transition portion 48 may be shaped to interact or seat against with one or more shaped surfaces of housing 12 such as one or more of surfaces such as pocket rear wall 32, pocket outer wall 34, pocket inner wall 36, and pocket transition portion 38 so as to align laser module 50 relative to housing 12 when seated. Accordingly, when resilient biasing member 110 resists application of pressure by the pressure surface 112, force 152 seats the seating surface against the shaped surfaces of housing 12 to bring laser system axis 56 into a desired position relative to housing 12 such as in closer alignment with housing axis 28 as illustrated in FIGS. 4 and 5. In embodiments, resilient coupling 40 itself may be compressed to an extent.

As cap 60 is tightened onto housing 12 compressive forces applied by optical element 100 and pressure surface 118 and forces 150 and 152 can position resilient member 40 to enclose or to substantially enclose gap 138 between optical element 100, resilient biasing member receiving wall 84 and resilient biasing member 110. This creates a second contaminant barrier within housing 12 such that the enclosed gap 138 acts as a primary trap 140 within which any contaminants that have passed between optical element engagement surface 72 and optical element 100 can be contained. In embodiments, one or more additional containment barriers may be provided to create for example a secondary trap. For example and without limitation a third barrier can be created by may be formed by resilient member 40, resilient coupling receiving wall 94, resilient biasing member 110, to create a secondary trap 142 within which contaminants may be contained before reaching aiming system 140.

In this embodiment, a front edge 52 of laser module 50 is set back longitudinally from optical element 100 to provide a forward maneuvering area 121 within which that laser module 50 can be adjusted axially for precise alignment with a discharge axis of a deterrent device to which aim enhancing system 10 may be joined. This prevents damage to optical element 100 during such adjustments.

The closing of gap 138 is accomplished simply by application of longitudinal forces applied during the mounting of cap 60 to housing 12. No axial assembly or clamping mechanisms are required. Additionally, no adhesives or sealants are required. This approach therefore greatly simplifies the assembly process.

This arrangement may also cause increased friction between housing 12 and resilient coupling 40 or between resilient coupling 40 and laser module 50 to the extent that this arrangement increases the extent of surface area of these structures that are in contact or to the extent that a greater force is applied across surface area in contact. This may have the effect of better securing the position of laser module 50 relative to resilient coupling 40 and may further enhance the alignment of laser system axis 56 with housing axis 28.

This embodiment enables optical element 100 to be positioned against optical element engagement surface 72 without requiring rigid connections such as those provided by certain adhesives, without the use of customized grommets and without requiring close tolerances or rigid mechanical fastening. Additionally, this embodiment can compensate for changes in dimensions that may occur as a result of thermal effects such as the use of aim enhancing system 10 at high or low temperature environments or thermal effects that might arise inside of housing 12 as a result of temperature changes.

Further, this embodiment allows optical element 100 some freedom to move relative to optical element engagement surface 72. For example, housing 12, cap 60, optical element 100, resilient biasing member 110 and pressure surface 118 can be defined and positioned in a manner such that when an external force above a predetermined level is applied against optical element 100 for example as a result of incidental contact or as a result of contact during aggressive cleaning efforts resilient biasing member 110 will permit movement of optical element 100 rather than require optical element 100 to be locked into a position and and required resist the entire force applied by such contact without damage to optical element 100 or to. For example, resilient biasing member 110 can have a hardness after assembly of aim enhancing system 10 that protects optical element 100 from damage by allowing optical element 100 to move inwardly and apart from optical element engagement surface 72 when a predetermined level of force is applied to exterior facing surface 102 of optical element 100 that is above a first threshold but below a level that will damage optical element 100. In one example of this type, the threshold force can be defined at a level that is below a level that will crack, warp, fracture, gouge, scratch or otherwise negatively impact the sealing or optical properties optical element 100. In embodiments of this type, the predetermined level of force may be defined at a level that is intended to protect any optical or protective coatings from damage. Once the force has been relieved, resilient biasing member 110 automatically returns optical element 100 into contact with optical element engagement surface 72.

It will be appreciated that allowing such a separation, even on a temporary basis can allow contaminants to enter into gap 138. However, as discussed above during assembly of cap 60 to housing 12 resilient biasing member is compressed against described above protects operative components of aim enhancing system 10 from exposure to any contaminants that entered during such incidents. Similarly, this arrangement can help to protect optical element 100 against damage caused by longitudinal accelerations such as may be experienced when aim enhancing system 10 is used in high shock or acceleration environments such as on vehicles or firearm type deterrent device.

In embodiments, any or all of resilient coupling 40, resilient biasing member 110 and resilient seal 130 can be can have a hardness and resiliency or can be adapted to interface with housing 12, cap 60 or optical element 100 to allow internal and external gas pressures to equalize without damaging contaminant barriers therebetween and without damaging functional components equipment such as optical element 100. This may be useful for example, when aim enhancing system 10 is subject to rapid changes in external or internal temperatures or pressures such as where optical illumination system used in parachute insertion operations or where internal heating of the device causes a rapid change of internal temperatures leading to increased gas pressures. For example, of resilient coupling 40, resilient biasing member 110 and resilient sealing member 130 can have a hardness and resiliency that is adapted to yield to large differences in gas pressure inside and outside of housing 12 so that such pressures do not permanently damage components of aim enhancing system 10 when equalizing.

In this way, an aim enhancing system 10 can be provided that can be used in a wide range of environments. This arrangement can also offers the benefit of providing greater positive control over the position of laser module 50, improved resistance to or resilience when exposed to shock and impulse effects, as well as removing the need for clamping mechanisms, tight tolerances or adhesives to hold optical element 100 in place in housing. This arrangement also removes the need for the use of substantial amounts of adhesives or heavily robust structures.

Additionally, in embodiments, assembly of cap 60, coupling 40 and laser module 50 into housing 12 can be achieved without reorienting housing 12 and/or with only the external fasteners being required. This also reduces the complexity of the product and associated costs.

As is also illustrated in FIGS. 1-6, an interface between housing 12 and cap 60 also presents a potential path by which contaminants might reach pocket 30, laser module 50, or optical element 100. However, in this embodiment, an inner surface 27 of cap 60 is arranged to closely engage with a cap engagement surface 17 of housing 12. In embodiments, a shape of inner surface 67 of cap 60 and a shape of cap engagement surface 17 of housing 12 may at least in part be substantially similar so that a portion of cap engagement surface 17 and housing of optical element 100 can be maintained in substantial contact to form an initial barrier restricting entry of contaminants between cap 60 and housing 12.

In this embodiment, resilient seal 130 is positioned between a cap seal engagement surface 66 and a housing seal compression surface 16 and as cap 60 is joined to housing 12, cap seal engagement surface 66 and housing seal compression surface 16. Housing 12, cap 60 and resilient seal 130 are arranged so that as cap 60 is tightened against housing 12 compressive forces are applied against resilient seal 130.

Resilient seal 130 may respond to these compressive forces by changing shape to conform to the shape of housing seal compression surface 16 and cap seal engagement surface 66 and by applying forces 160 and 162 that press against housing seal compression surface 16 and cap seal engagement surface 67 to substantially eliminate or substantially reduce the extent of any separations between housing seal compression surface 16, cap seal engagement surface 66 and resilient seal 130. This creates a second barrier to contaminant entry between cap 60 and housing 12, and can create a primary trap 144 between housing seal compression surface 16, resilient coupling 40, cap seal engagement surface 66, resilient coupling engagement surface 92, resilient coupling receiving wall 94, and resilient seal 130.

As is also shown in FIG. 6, in this embodiment a secondary trap 146 may be provided to trap any contaminants passing resilient seal 130 and secondary trap 146 may comprise a surface of cap 60, one or more surfaces of pocket 30 and one or more surfaces of resilient coupling 40. As discussed above, force 152 applied against resilient coupling 40 can help resilient coupling 40 to maintain a sealing arrangement with cap 60 and housing 12.

In embodiments, the use of a primary trap 144 and a secondary trap 146 can provide a layered resistance to fluid entry. For example, in the embodiment of FIGS. 1-6, primary trap 144 and a secondary trap 146 can be used to block or substantially delay the penetration of pressurized fluids such as water between housing 12 and cap 60. For example, an ambient water pressure may be sufficient to win past resistance to flow provided between cap inner surface 67 and cap engagement surface 17. However, it will take time for the pressure of this water to fill a primary trap 144 along this path and then to pressurize the water in primary trap 144 to an extent necessary for this water to penetrate the barrier provided between cap 60, housing 12 and resilient seal 130. However, the filling of secondary trap 146 is rate limited by the rate at which water can pass between optical element engagement surface 72 and optical element 100, not to fill but to fill and re-pressurize primary trap area 144 to a level where water can again pass into secondary trap 146. Because water however will not exit from secondary trap 146 to enter other areas of housing 12 until the water pressure in secondary trap 146 can reach a pressure that is sufficient to penetrate aim enhancing system 10 can be capable of managing submersion for a meaningful period of time. Similar results can occur, for example, in the event that water enters between housing 12 and cap 60 and must pass through a primary and a secondary trap along a path into housing 12. Similar results may be experienced when aim enhancing system 10 is exposed to other fluids. In embodiments, any trap described herein may contain a desiccant to absorb any penetrating water or other absorbent material intended to absorb other fluids. It will be appreciated that primary trap 140 and secondary trap 144 may also work in a similar fashion and optionally as shown in the embodiment of FIGS. 1-6 secondary trap 142 and secondary trap 144 may optionally be linked to provide combined contaminant storage volume.

This arrangement can likewise be used to provide many of the advantages described above.

Returning again to FIG. 1, illumination system 200 having a first illuminator subsystem 210 having a first light emitter 214 that is positioned to emit light into an opening of a first reflector 216 that directs light out of a first opening in illumination system cap 230. FIG. 1 also shows a second illuminator subsystem 220 that emit light from a first opening 212 and a second opening 222 respectively in an illuminator system cap 230. In this embodiment, illuminator system cap 230 is shown mounted to housing 12 by way of illumination system cap fasteners 236. In this embodiment, first illuminator subsystem 210 and second illuminator subsystem 220 allow a user to choose from between two different types of light to illuminate a scene. For example, a light that is visible to the naked eye may be emitted by first illuminator subsystem 210 and a light can be detected only by electronic imagers may be emitted by second illuminator system 220. In embodiments, more than one type of visible light or more than one oft that can be detected by an electronic imager.

A consistent challenge in the design of portable and weapon mounted aim enhancing devices is that of incorporating multi-spectral illuminating capabilities in a light weight and relatively compact system that provides enough light in a scene to allow a user to quickly and accurately make tactical decisions. Additionally such systems should be operable for a tactically useful period of time without requiring battery charging or replacement.

A complicating factor in the design of illuminator subsystems systems 210 and 220 is divergence. Divergence causes the amount of space illuminated by a beam to increase with distance while the total power of the beam does not increase with distance. As a result intensity of the illuminating light in an area of interest will effectively decrease with distance from the source. This can be offset by increasing the power of illumination at the source, however, doing so increases the power consumption of the illumination source and may require larger and heavier batteries or more frequent battery changes. Additionally, higher powered illuminators generate more heat, requiring advanced thermal management systems to keep such illuminators thermally stable. Such systems add weight and cost. Addressing these needs can become more even complex when multiple different types of illuminators are required in a common system that is to be of a small size.

What is needed therefore is a system that provides illuminating an area of concern with an advantageous level of light (visible or otherwise) and without creating tactical disadvantages through added weight, volume, or reduced operational time.

Figure 7:
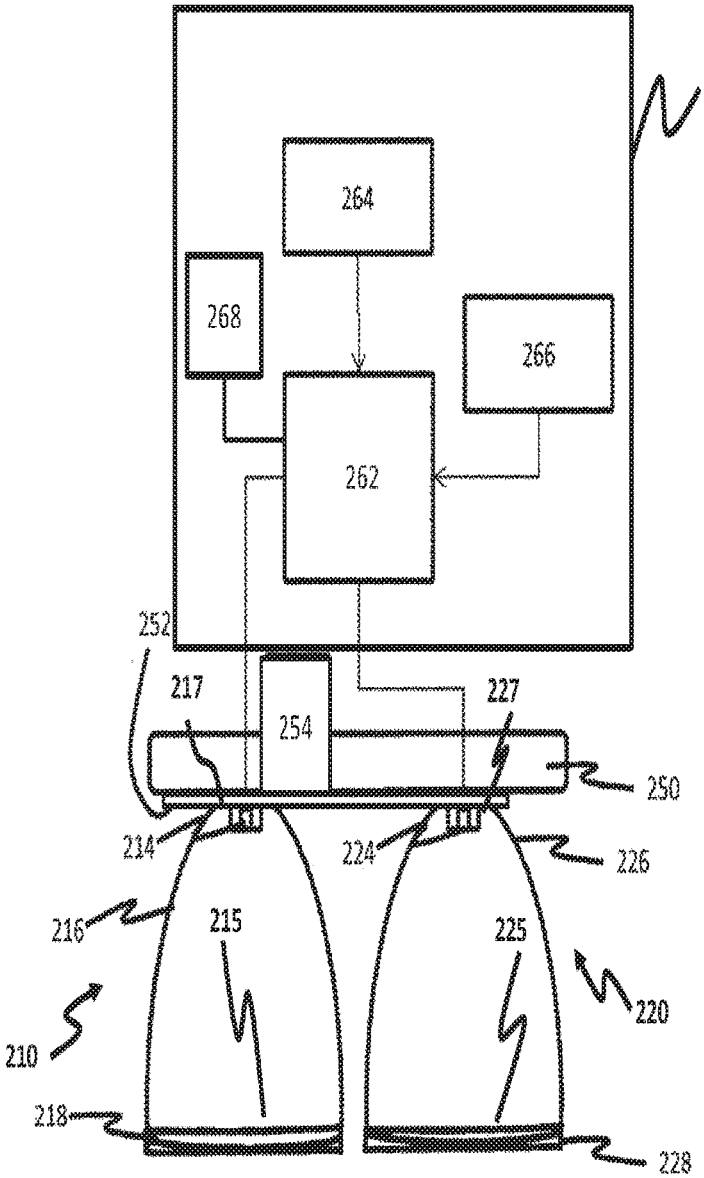
FIG. 7 is a top system view of one embodiment of an illumination system.
Figure 8:
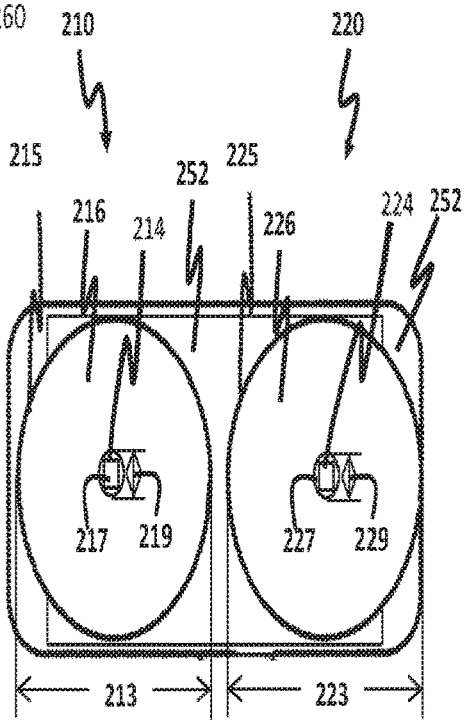
FIG. 8 is a front system view of the embodiment of FIG. 6
Figure 9:
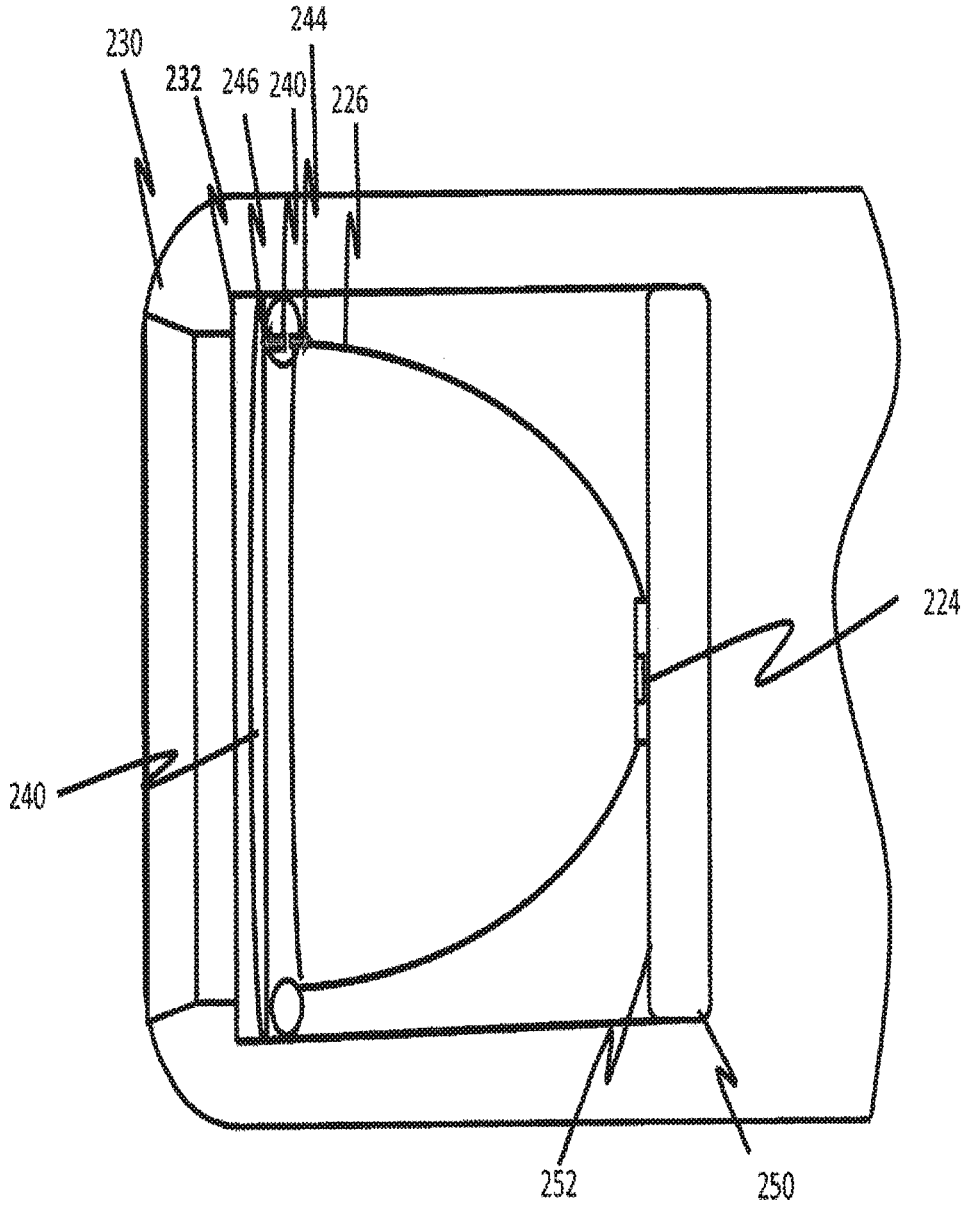
FIG. 9 is a top view of the embodiment of FIG. 7.

FIGS. 7 and 8 show top and front views of the embodiment of illumination system 200 of FIGS. 1-6 with housing 12 and cap removed while FIG. 9 shows a left side section of view of illumination system 200 with housing 12 and illumination system cap 230 illustrated in As is shown in FIGS. 1-9, first illuminator subsystem 210 includes a first light emitter 214 which may, for example, emit a visible light into a first parabolic reflector 216 with such light being reflected by first reflector 216 through a first optical element 218, through a first opening 212 have a predetermined divergence into a scene.

Similarly, in the embodiment of FIGS. 7-9, second illuminator subsystem 220 includes a second light emitter 224 that may emit light in a non-visible wavelength. Non-visible light emitter 224 emits non-visible light such as long wave infrared (LWIR), mid-wave infrared (MWIR), short wave infrared (SWIR), "near" infrared "NIR" or ultraviolet light, into a second reflector 226 which may, for example, be a parabolic reflector from which non-visible light is reflected through a second optical element 228, through an opening 222 along a path that leads to a scene.

To help aim enhancing system 10 to maintain a small size and yet provide a desired degree of illumination within an illuminated portion of a scene at any of a variety of ranges from illumination system 200, it is necessary that illumination system 200 is capable of emitting light having a divergence that is within a predetermined range of divergences. It will be appreciated that the predetermined range of distances decreases monotonically as a distance from illumination system 200 increases, such that, for example, a narrower range of divergences is required for a beam of constant power to create a predetermined illumination of a scene that is at a first distance from the emitter while a second wider range of divergences may provide similar illumination of a scene that is that is at a second and smaller distance from the emitter.

It is known to use parabolic reflectors in illuminators such as flashlights to control an extent of the divergence of emitted light. However, such parabolic reflectors however accept and reflect light in a low divergence manner only to the extent that such light is introduced into the system from within a predetermined range of positions that may be referred to as an entrance slit. Light that is introduced into such a parabolic reflector from outside of the entrance area will not necessarily be reflected from the parabolic reflector with a desired narrow range of divergence making the illuminator less effective at providing light within a desired range of positions relative to the illuminator. A challenge in providing illumination systems is that the size of the entrance monotonically decreases with the size of the parabolic reflector. This can lead to 'clipping' of the light generated by the illuminator with some of the light being focused to form a low divergence emission and with other portions of the light being lost. Additionally, a parabolic reflector has a focal length. The size of the emitter that can be used in a system that is to generate a specific divergence is inversely proportional to the focal length and therefore the size of the emitter is proportional to the size of the parabolic reflector.

This effect appears to influence the design of products such as the Streamlight TLR-VIR Weapon Mounted Visible and IR LED tactical illuminator sold by Streamlight, Inc., Eagleville, Pa., USA which seeks to provide a more concentrated beam of visible light by introducing this visible light into a single "deep dish" parabolic reflector. Such reflectors can be on the order of 25 mm in diameter at an emission end. This is a large add on for many deterrent devices and in particular for hand held deterrent devices such as pistols and rifles. Given the large commitment of space to the visible light reflector, making it difficult to use a parabolic reflector for providing low divergence infrared illumination in the same system without substantially expanding the size of the system.

In aim enhancing system 10, the size of first reflector 216 and second reflector 226 are both parabolic are made smaller while providing high powered light with limited divergence emitters having an emission surface of less than about 2.0 mm in maximum diameter or other maximum dimension, or less than about 4 mm squared. By reducing the size of the emitter it becomes possible to achieve lower divergences using a smaller parabolic reflector. For example, in one embodiment an emitter having a surface area of 1 mm on a side can be used with first parabolic reflector 216 or a second parabolic reflector 226 having a diameter of less than about 13 mm while still achieving divergences of less than about 10%. Such a result can deliver a beam that illuminates a scene with sufficient illumination to allow a user to identify the presence of weapons at distances of 50 meters or more.

In embodiments, examples of visible light emitters can be used as first light emitter 214 can include but are not limited to the white light LED XQEAWT-HO-0000-00000LFE1 or the XQEAWT-HO-0000-00000BFE1 and equivalents. In embodiments an example of a non-visible light emitter that can be used is the infrared LED SFH-14770S sold by Osram. Suitable parabolic reflectors 216 and 226 may include reflectors having the one or more of the following characteristics: as illustrated in FIGS. 7-9, diameters 213 or 223 of less than about 13 mm on at emission openings such as emission openings 215 or 225, respectively, and illumination openings 217 and 227 respectively having diameters 219 and 229 respectively that are less than about a 2-4 mm or other long dimension. In embodiments, parabolic reflectors 216 and 226 can be made using metal coated, metalized, or metals, or a combination such as a formed parabolic shape made from a metal, plastic or ceramic and coated with a reflective metal. In embodiments, parabolic reflectors 216 and 226 can be formed at least in part from common substrates or materials, such as by forming two half parabolas using a single substrate and assembling these to matching pair of half parabolas in a clamshell or other assembly process.

When smaller light emitting surfaces of this type emit light that is then reflected by such parabolic reflectors, a beam of light can be provided that has a relatively narrow degree divergence such as less than 10° divergence without requiring heavy and complicated lens systems while using comparatively small reflectors such as reflectors 216 and 226 having emission openings 215 and 225 with diameters 213 and 223 that may be less than 1.5 cm in diameter.

With decreased divergence, the intensity of light emitted by either first illuminator subsystem 210 or second illuminator 220 remains more concentrated at an area of interest relative to aim enhancing system 10 while offering the advantages of a small size and efficient power consumption while remaining a relatively light weight system. Additionally, the smaller size allows a user of a greater freedom of movement when using deterrent device combined with to such an aim enhancing system as the combination is easier to insert and remove from storage and has a lower risk of snagging on clothing or nearby equipment. Such a system is particularly well-suited for targeting or evaluating conditions in a scene that is substantially down range from aim enhancing system 10, in that it provides a greater opportunity for object recognition at a greater distance and shorter period of time.

It will be appreciated that visible and non-visible light emitters such as first light emitter 214 and second light emitter 224 are not 100% efficient. Such devices typically use at least 70 percent of the power supplied to them in converting energy into heat with the remainder converted into light. High power light emitters 214 and 224 of the sizes described and claimed herein present a particular challenge in this regard in that such smaller sized emitters generate substantial amounts of heat in more concentrated areas.

FIGS. 7, 8 and 9 having both first light emitter 214 and second light emitter 224 positioned on a common support board 250. In this embodiment, common support board 250 has a thermal transfer material 252 acting to receive heat from whichever of first light emitter 214 and second light emitter 224 is active. Support board 250 may optionally include an additional thermally conductive mass 254 in thermal communication with thermal transfer material 252 or other components of support board 250 so as to allow additional thermal energy created by either first light emitter 214 or second light emitter 224 to be rapidly drawn away from either first light emitter 214 or second light emitter 224.

In the embodiment of FIGS. 7, 8 and 9, first light emitter 214 and second light emitter 224 are controlled by a control system 260. Control system 260 has a controller 262 that receives inputs from sensors 264 such as user input devices, controls, or communications systems and generates signals that control operation of first light emitter 214 and second light emitter 224. A power supply 266, such as a battery or fuel cell or other source of electrical energy, supplies control system 260 with power. Additionally, in this embodiment, control system 260 is connected to and controls a aiming system driver 268 which may activate laser module 50, deactivate laser module 50 or control emissions therefrom. Similarly, control system 260 may activate, deactivate, or otherwise control any other form of aiming light emitter.

Control system 260 does not activate both of first light emitter 214 and second light emitter 224 at the same time. In this way, support board 250 is not required to have sufficient thermal management capabilities to enable operation of both first light emitter 214 and second light emitter 224 but rather can be defined to manage heat generated by the emitter that generates more heat if there are differences in the amount of such heat generated. This helps to reduce the cost and weight of the system.

Additionally, in embodiments, first reflector 216 and second reflector 226 may be made in part of thermally conductive material such as by having a metallic core, surface or metallic path. In this regard, thermal transfer material 252 may provide a thermal path provided between first light emitter 214 and second reflector 226 so that second reflector 226 can be used to help absorb and radiate heat generated by first light emitter 214 when first light emitter 214 is active. Similarly, thermal transfer material 252 may provide a thermal path between second light emitter 224 and first reflector 216 so that first reflector 216 can be used to absorb or to radiate heat generated by second emitter 224. In embodiments common support board 250 can comprise such a thermal path. In other embodiments, first reflector 216 and second reflector 226 can be in direct thermal contact such as by being made from a common thermally conductive substrate or by being placed in substantial contact with such thermal path comprising thermal transfer material 252 or an additional thermal transfer path.

FIG. 9 also illustrates a cutaway side view of illuminator system cap 230 joined to housing 12 showing second illuminator 224, second reflector 226, an illuminator subsystem optical element 228, support board 250 and thermally conductive material 252, and a biasing member 240. In this embodiment, second reflector 226 is positioned with emitting opening 223 positioned opposite an opening 222 of an illumination system cap 230 and with a second emitter 224 positioned at input opening 227 of second reflector 226. A biasing member biasing member 240 is positioned between second reflector 226 and an illuminator system optical element engagement surface 272. A second optical element 228 is positioned between an optical element engagement surface 272 of second cap 230 and support board 250. Illuminator subsystem optical element 228 may have an optical power or not.

Second cap 230 an illuminator subsystem optical element receiving space 270 with an optical element engagement surface 272 against which an exterior facing surface 102 of optical element 100 can be positioned. In the embodiment of FIGS. 1-3 optical element engagement surface 72 begins at opening 64 and extends generally axially therefrom to an optical element receiving wall. In embodiments, a shape of optical element engagement surface 72 and a shape of exterior facing surface 102 of optical element 100 may at least in part be substantially similar so that a portion of optical element engagement surface 72 and exterior facing surface 102 of optical element 100 can be maintained in substantial contact around opening 64 to form a primary barrier restricting entry of contaminants through opening 64 when such substantial contact is maintained.

Optical element receiving wall 74 defines a longitudinal separation between optical element engagement dace 72 and resilient biasing member receiving space 80 and is generally shaped and sized to enable a perimeter of optical element 100 to be positioned therein and to enable a thickness of optical element 100 or a portion thereof to be positioned therein. Optionally, a perimeter of optical element receiving wall 74 can be smaller than a perimeter of optical element 100. For example, in the embodiment of FIGS. 1-6, optical element 100 is illustrated as a disk shaped window having an optical element radius 106 while optical element receiving wall 74 takes a generally cylindrical form having an optical element receiving wall radius 76 that is larger than optical element radius 106.

In this embodiment, second reflector 226 may be positioned between board 250 provides a pressure surface 229 that applies pressure against biasing member 240 during assembly.

Second optical element 228 may be assembled against optical element receiving surface 234 followed by a resilient second illuminator bias member 240. Here, as above, as second cap 230 is joined to housing 12 force is applied to biasing member 240 distorting illuminator subsystem biasing member 242. This causes biasing member 240 to resist the bias by applying forces 244 and 246 that, respectively are applied against positioning surface 234 to urge second reflector 226 against board 250 and against second optical element 228 to urge second optical element 228 against optical element receiving surface 232. Here too, this arrangement provides shock protection, eliminates the need for adhesives and sealants or close tolerance structures and rigid mountings. Further, this arrangement can enable single axis assembly.

It will be appreciated that using this embodiment, a trap area 280 can be provided to contain any contaminant that passes between optical element 228 and optical element engagement surface 272. Additionally, in embodiments, housing 12 and second reflector 226 can be defined to create additional trap areas including housing 12 and second reflector 226 and one or more additional resilient elements. In embodiments, contaminants caught in trap area 120

In embodiments any of resilient member 40, resilient biasing member 110, resilient seal 130, and biasing member 240 can be made using for example a resilient material such as a nitrile rubber, rubber, vinyl, synthetic polyisoprene, polyurethane, and silicone. Such a resilient material can have, for example a Type A durometer hardness between about 30 and 90.

Optical element 100, first illuminator optical element 218, and second illuminator optical element 228 can take any of a variety of forms, in embodiments, optical element 100 can comprise a window, a lens, a light pipe, a diffractive element or any other object or structure through which light from a light emitter can pass. In embodiments, housing 12 may take the form of a component of a firearm or deterrent device including but not limited to a grip, handle, foregrip, stock, rail, or other component.

It will further be appreciated that a deterrent device to which aim enhancing system 10 can be joined may take the form of a firearm such as and without limitation a pistol, a rifle, shotgun, a chemical irritant disperser, a non-lethal projectile launcher, or a directed energy weapon including but not limited to a device that emits a sonic, optical or electrical discharge or electromagnetic field alone or in combination with a projectile.

Other exemplary embodiments will be apparent to those skilled in the art from consideration of the specification and practice of the invention disclosed and claimed herein and it is intended that the specification and examples be considered as exemplary only.

What is claimed is:

1. An aim enhancing system for a deterrent device comprising:

a control system operable to activate one of a first light emitter and a second emitter;

a support board supporting the first light emitter and the second light emitter, and having a thermally conductive material among the first light emitter, the second light emitter and one or more components of the aim enhancing system such that the thermally conductive material acts as a heat sink to receive heat from the first emitter when the first emitter is emitting light and from the second emitter when the second emitter is emitting light;

an optical element through which light emitted by the first light emitter and the second light emitter passes, the optical element comprising a first inner surface;

a resilient biasing member comprising an opening through which the light passes, an outer surface in contact with the first inner surface, and a second inner surface; and a coupling comprising a pressure surface, the pressure surface being in contact with the second inner surface to hold the outer surface of the resilient biasing member against the first inner surface.

2. The aim enhancing system of claim 1, wherein the thermally conductive material is configured to transfer thermal energy to at least one reflector of the aim enhancing system such that the at least one reflector acts as a heat sink.

3. The aim enhancing system of claim 1, wherein the first light emitter has a first reflector in thermal communication with the thermally conductive material and wherein the first reflector receives thermal energy from the thermally conductive material when the second light emitter is emitting light.

4. The aim enhancing system of claim 3, wherein the second light emitter has a second reflector in thermal communication with the thermally conductive material and wherein the second reflector receives thermal energy from the thermally conductive material when the first light emitter is emitting light.

5. The aim enhancing system of claim 1, wherein the thermally conductive material is configured to transfer thermal energy into a mass of thermally absorbent material in thermal communication with the thermally conductive material.

6. The aim enhancing system of claim 1, wherein the resilient biasing member comprises a ring.

7. The aim enhancing system of claim 1, wherein the resilient biasing member is configured to protect the optical element from damage by allowing the optical element to move toward the pressure surface when a force is applied to an outer surface of the optical element that is above a first threshold but below a second threshold that will damage the optical element.

8. The aim enhancing system of claim 7, wherein the resilient biasing member is configured to urge the optical element to return to contact with a receiving surface of the optical element at least partly in response to application of the force.

9. A deterrent device including an aim enhancing system, the aim enhancing system comprising:

a control system operable to activate one of a first light emitter and a second light emitter;

a support board supporting the first light emitter and the second light emitter, and having a thermally conductive material disposed among the first light emitter, the second light emitter and one or more components of the aim enhancing system such that the thermally conductive material receives heat from the first light emitter when the first light emitter is emitting light and from the second light emitter when the second light emitter is emitting light;

an optical element through which light emitted by the first light emitter and the second light emitter passes, the optical element comprising a first inner surface;

a resilient biasing member comprising an opening through which the light passes, an outer surface in contact with the first inner surface, and a second inner surface; and a coupling comprising a pressure surface, the pressure surface being in contact with the second inner surface to resiliently hold the outer surface of the resilient biasing member against the first inner surface.

10. The deterrent device of claim 9, wherein the thermally conductive material is configured to transfer thermal energy to at least one reflector of the aim enhancing system.

11. The deterrent device of claim 9, wherein the first light emitter has a first reflector in thermal communication with the thermally conductive material, and wherein the first reflector receives thermal energy from the thermally conductive material when the second light emitter is emitting light.

12. The deterrent device of claim 11, wherein the second light emitter has a second reflector in thermal communication with the thermally conductive material, and wherein the second reflector receives thermal energy from the thermally conductive material when the first light emitter is emitting light.

13. The deterrent device of claim 9, wherein the thermally conductive material is configured to transfer thermal energy to a mass of thermally absorbent material in thermal communication with the thermally conductive material.

14. The deterrent device of claim 9, wherein the resilient biasing member comprises a ring.

15. The deterrent device of claim 9, wherein the resilient biasing member is configured to protect the optical element from damage by allowing the optical element to move toward the pressure surface when a force is applied to an outer surface of the optical element that is above a first threshold but below a second threshold that will damage the optical element.

16. The deterrent device of claim 15, wherein the resilient biasing member is configured to urge the optical element to return to contact with a receiving surface of the optical element at least partly in response to application of the force.

17. A method, comprising:

providing a support board of an aim enhancing system;

coupling a first light emitter and a second light emitter to the support board;

providing a thermally conductive material among the first light emitter, the second light emitter, and one or more components of the aim enhancing system such that the thermally conductive material receives heat from the first emitter when the first light emitter is emitting light and from the second light emitter when the second light emitter is emitting light;

coupling a control system to the support board, the control system operable to activate one of the first light emitter and the second emitter, wherein the control system includes a controller that receives inputs from one or more user input devices, controls, or communications systems and generates signals that control operation of the first light emitter and the second light emitter 224;

coupling an optical element to the support board, the optical element configured to receive light emitted by the first light emitter and the second light emitter;

placing an outer surface of a resilient biasing member in contact with an inner surface of the optical element; and placing a pressure surface of a coupling in contact with an inner surface of the resilient biasing member to resiliently hold the outer surface of the resilient biasing member against the inner surface of the optical element.

18. The method of claim 17, further comprising:

placing a first reflector of the first light emitter in thermal communication with the thermally conductive material, wherein the first reflector receives thermal energy from the thermally conductive material when the second light emitter is emitting light.

19. The method of claim 18, further comprising:

placing a second reflector of the second light emitter in thermal communication with the thermally conductive material, wherein the second reflector receives thermal energy from the thermally conductive material when the first light emitter is emitting light.

* * * * *